US007436934B2

(12) United States Patent
Hartick et al.

(10) Patent No.: US 7,436,934 B2
(45) Date of Patent: Oct. 14, 2008

(54) COLLIMATOR WITH ADJUSTABLE FOCAL LENGTH

(75) Inventors: Martin Hartick, Bad Nauheim (DE); Norbert Haunschild, Aarbergen (DE); Andreas Streyl, Alzey (DE)

(73) Assignee: Smiths Heimann GmbH, Wiesbaden (DE)

( * ) Notice: Subject to any disclaimer, the term of this patent is extended or adjusted under 35 U.S.C. 154(b) by 0 days.

(21) Appl. No.: 11/854,535

(22) Filed: Sep. 12, 2007

(65) Prior Publication Data

US 2008/0089478 A1 Apr. 17, 2008

Related U.S. Application Data

(63) Continuation of application No. PCT/EP2006/002252, filed on Mar. 10, 2006.

(30) Foreign Application Priority Data

Mar. 12, 2005 (DE) ..... 10 2005 011 467

(51) Int. Cl.
*G21K 1/04* (2006.01)
*G21K 1/02* (2006.01)

(52) U.S. Cl. ..... 378/150; 378/149

(58) Field of Classification Search ..... 378/57, 378/70–83, 85–90, 147–151, 156–159
See application file for complete search history.

(56) References Cited

U.S. PATENT DOCUMENTS

| | | | | |
|---|---|---|---|---|
| 3,197,638 | A * | 7/1965 | Sinclair | 378/86 |
| 3,373,286 | A * | 3/1968 | Han | 250/359.1 |
| 4,086,494 | A | 4/1978 | Malak | |
| 4,825,454 | A | 4/1989 | Annis et al. | |
| 5,008,911 | A * | 4/1991 | Harding | 378/86 |
| 6,483,894 | B2 * | 11/2002 | Hartick et al. | 378/147 |
| 7,075,073 | B1 * | 7/2006 | Janik et al. | 250/310 |
| 2002/0181656 | A1 * | 12/2002 | Ries et al. | 378/147 |
| 2003/0169843 | A1 * | 9/2003 | Ries et al. | 378/58 |

FOREIGN PATENT DOCUMENTS

| | | |
|---|---|---|
| DE | 2003753 | 9/1970 |
| DE | 3323477 A1 | 1/1984 |
| DE | 19954661 A1 | 5/2001 |
| DE | 10330521 A1 | 2/2005 |
| EP | 0811991 A1 | 12/1997 |
| FR | 2801103 A1 | 5/2001 |

* cited by examiner

*Primary Examiner*—Edward J. Glick
*Assistant Examiner*—Anastasia Midkiff
(74) *Attorney, Agent, or Firm*—Muncy, Geissler, Olds & Lowe, PLLC

(57) ABSTRACT

A collimator is provided with an adjustable focal length, particularly in X-ray testing systems, comprising an outer part with a conical inner surface and with a inner part having an conical outer surface, which are connected to one another at a fixed distance, as well as with at least one cone sliding part situated between the inner part and outer part in a manner that enables it to move.

7 Claims, 2 Drawing Sheets

COLLIMATOR WITH ADJUSTABLE FOCAL LENGTH

This nonprovisional application is a continuation of International Application No. PCT/EP2006/002252, which was filed on Mar. 10, 2006, and which claims priority to German Patent Application No. DE 102005011467, which was filed in Germany on Mar. 12, 2005, and which are both herein incorporated by reference.

BACKGROUND OF THE INVENTION

1. Field of the Invention

The present invention relates to a collimator having an adjustable focal length, particularly in X-ray inspection systems.

2. Description of the Background Art

Inspection processes using X-rays are used for the detection of critical substances and objects in pieces of luggage or other freight. To this end, multi-stage systems are known whose first stage is based on the absorption of X-rays. For the detection of certain critical substances, such as explosives for example, a second stage is used, with objects from the first stage being selectively delivered thereto. Systems whose operating principle is based on diffraction phenomena are used as the second stage. In this connection, the diffraction angle at which an incident X-ray beam is diffracted depends on the atomic lattice spacing of the material to be inspected as well as on the energy, and thus the wavelength, of the incident radiation. Conclusions can be drawn concerning the lattice spacing and thus the material through analysis of the diffraction phenomena by means of X-ray detectors. Such a two-stage system is disclosed in German patent application 103 30 521.1, for example.

Since X-ray inspection systems operate with extremely low radiation intensities, very sensitive detectors are used. Therefore, to avoid measurement inaccuracies, it is necessary to ensure that only radiation generated by the inspection device strikes the detector. In addition, care must be taken to ensure that only radiation diffracted at a single point is detected, since localization within the object to be inspected is otherwise impossible. Thus, spatial filtering is necessary, which is accomplished by a so- collimator.

Since it is technically very complicated to generate monochromatic X-rays, the sharply defined X-ray beam used for inspection, which is known as a pencil beam, has an energy spectrum that is known from measurements, for example. The result of the Bragg equation is that the incident radiation is diffracted at every point through an angle that depends on the energy of the radiation. Thus, radiation with an energy spectrum is diffracted over an angular range; the diffraction here is rotationally symmetric about the incident pencil beam. In an X-ray inspection, it is desirable to detect only radiation diffracted through a specific angle. This, too, is achieved through the use of a collimator. The transmission range of the collimator corresponds essentially to the surface of a cone whose tip coincides with the point whose diffraction characteristics are to be examined. To examine a region within an object, a large number of points must be focused.

For this purpose, it is known to use a collimator that has multiple parallel apertures with the same aperture angle, and with which it is thus possible to simultaneously focus multiple points on the axis of rotation. However, the use of a non-segmented detector that does not resolve position, and thus provides a common output signal for all focused points, has the disadvantage that the analysis and unambiguous association of the detected radiation to a point of diffraction are difficult. While this disadvantage does not arise when using a segmented detector, which is divided into circular rings that can be analyzed separately, for example, such a detector is complicated and expensive.

Known from German patent application 103 30 521.1, which is incorporated herein by reference, is a method for examining an object space in which the arrangement includes a detector and collimator can be made to travel in the direction of the incident X-ray beam. However, the entire apparatus must have an overall height of more than twice the height of the object to be examined.

SUMMARY OF THE INVENTION

It is therefore an object of the present invention to provide a collimator such that shorter travel paths and thus reduced overall height of the X-ray inspection device result.

Basically, a collimator according to the invention has an outer part that can simultaneously assume the function of a housing and has a conical inner surface, and an inner part that has a conical outer surface. These two parts are rigidly connected to one another at a fixed distance, so that a gap is formed between them. Located in this gap is at least one movably arranged hollow cone, which is also called a cone sliding part. The focal length of the collimator can be varied by sliding the movable cone or cones.

As already described above, ideally only radiation diffracted at one angle from one point reaches the X-ray detector in X-ray inspection systems. Thus, spatial filtering is necessary. In this regard, the optimal spatial filter characteristic is one that results in a transmission range having the shape of the surface of a cone. This is achieved in the inventive collimator by the means that all conical surfaces are arranged concentrically about a common axis of rotation, wherein the axis of rotation corresponds to the direction of incidence of the pencil beam.

To identify a substance in an object to be inspected, the diffraction spectrum detected at a specific angle is compared to the spectrum of the pencil beam. It follows from the Bragg equation that a diffraction spectrum recorded at a different angle is displaced relative to the first. Consequently, identification is simplified if every measurement is performed using the same aperture angle. A constant detection angle of the collimator is achieved by the means that all conical surfaces have the same aperture angle.

Different detection angles as a function of the focal length that is set can be achieved through different aperture angles of the conical surfaces. It is advantageous in this regard for every pair of adjacent conical surfaces to have the same aperture angle. As a result of this paired matching, large areas of the conical surfaces rest against one another, resulting in high radiation absorption by the collimator.

The focal length is set by the means that the at least one cone sliding part can be made to travel along the axis of rotation. In this way, the focus of the collimator can be adjusted by a simple translational motion of the cone sliding part in one direction.

Hence, the adjustment of the focal length of the collimator, and thus of the focused point in the object to be inspected, is accomplished by the means that the at least one cone sliding part is moved along the axis of rotation until the desired focal length is achieved, wherein, when multiple sliding cones are used, they can be moved independently of one another. In order to achieve an optimal spatial filtering effect, the cone sliding part or parts should always be positioned such that the collimator has only one aperture gap. When all conical surfaces are arranged concentrically about a common axis of rotation, and adjacent surfaces each have the same aperture angle, the surfaces fit closely against one another over their entire height. Except in the region of the selected gap, the entire collimator thus appears as a solid unit, permitting maximum shielding of the unwanted X-rays. As a result of the fact that the individual cone sliding parts can be moved independently of one another, it is thus possible to create a single gap at various positions. This permits an equal number of possible focal lengths. For a number n of cone sliding parts, the result is n+1 possible gaps.

A number of advantageous possible applications exist for a collimator with adjustable focal length according to the present invention. In a first case, the collimator can be held at a fixed position and multiple points in an object can be focused by moving the cone sliding part or parts. Alternatively, it is possible to move the collimator linearly, thus performing a continuous measurement of the object to be inspected. In this case, the travel path can be reduced by the means that the focal length is switched after the collimator has traveled a certain path, and a different examined region results when the collimator is moved along the same path anew. In the ideal case, the maximum required travel path of the inventive collimator is reduced as compared to a nonadjustable collimator by a factor corresponding to the number of focal lengths that can be set, or in other words by half in the case of a collimator with two focal lengths.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
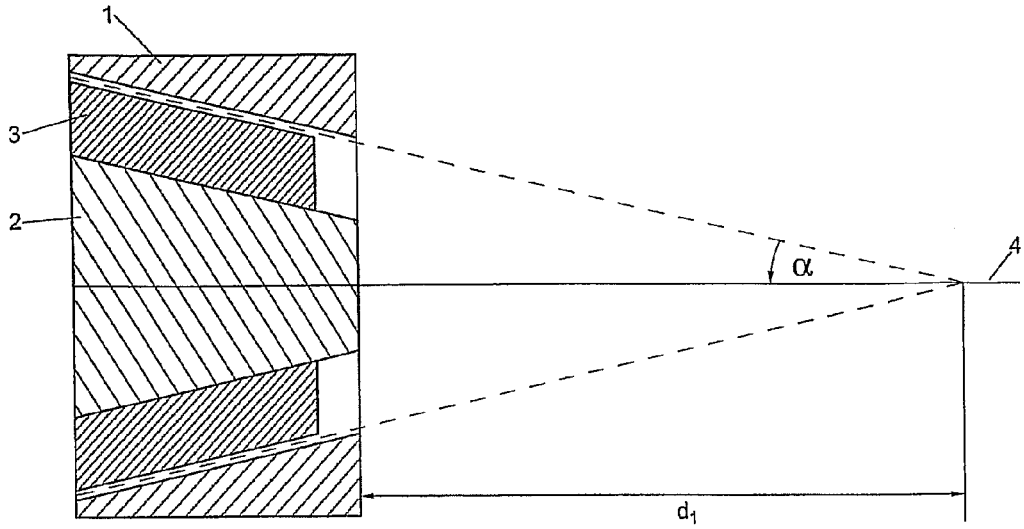
FIG. 1*a* illustrates a collimator with adjustable focal length with one cone sliding part in one end position.
Figure 1B:
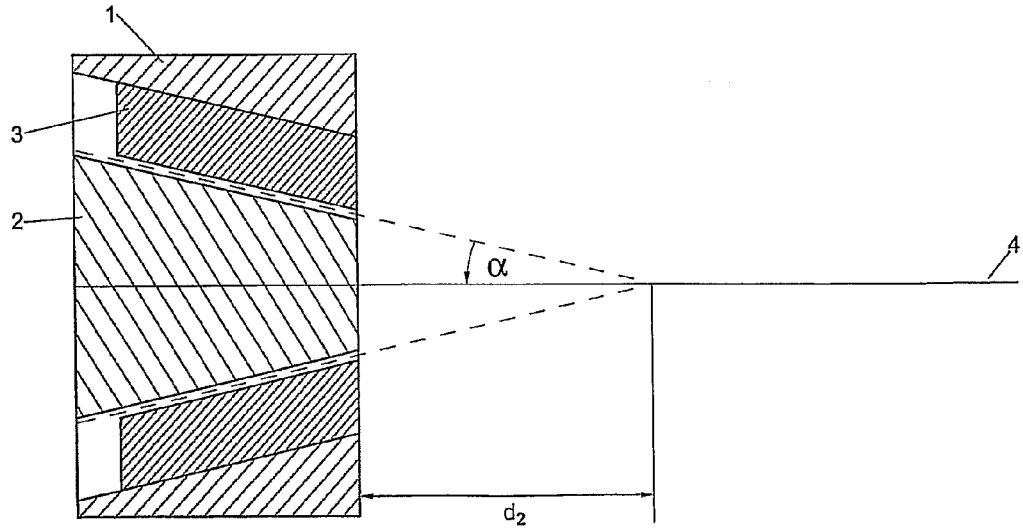
FIG. 1*b* illustrates a collimator with adjustable focal length with one cone sliding part in the other end position.
Figure 2:
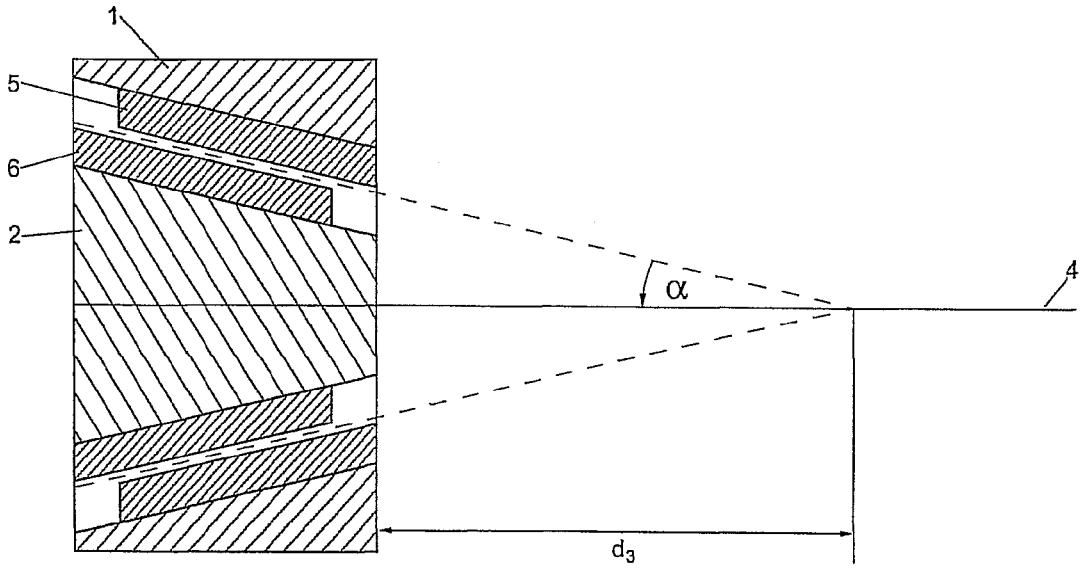
FIG. 2 illustrates a collimator with adjustable focal length with two cone sliding parts.

In all the figures, the inventive collimator has an outer part 1 and an inner part 2; these parts are arranged concentrically about an axis of rotation 4. In FIGS. 1*a* and 1*b* the collimator has one cone sliding part, while it has two cone sliding parts in FIG. 2. Such collimators find particular application in X-ray inspection systems, especially in higher stages of multi-stage inspection systems.

In FIG. 1*a*, the cone sliding part 3 is located in an end position in which it rests against the inner part 2. Consequently, a transmission gap for the radiation results between the cone sliding part 3 and outer part 1. In this case, the collimator filters out all radiation that is not diffracted through an angle $\alpha$ from a point at a distance $d_1$ from the collimator.

In FIG. 1*b*, the cone sliding part 3 is resting against the outer part 1. Consequently, a transmission gap results between the cone sliding part 3 and inner part 2. The aperture angle $\alpha$ of the collimator remains unchanged, but in this position a point at a distance $d_2$ from the collimator is focused. It is immediately evident that switching the position of the cone sliding part 3 varies the region focused during travel of the collimator. This means that the travel path of the collimator is reduced for a specific region to be inspected. In the extreme case, this savings amounts to half the extent of the region to be inspected.

In FIG. 2, the collimator again has an outer part 1 and an inner part 2, but has two cone sliding parts 5 and 6 that are movable independently of one another. In the position shown, the cone sliding part 5 rests against the outer part 1 and the cone sliding part 6 rests against the inner part 2. The result is a focusing on a point at a distance $d_3$, again at the aperture angle $\alpha$. In case that the cone sliding parts 5 and 6 rest against one another, the result is the focal lengths $d_1$ and $d_2$ already shown in FIGS. 1*a* and 1*b*.

The focal length of the inventive collimator is adjusted by the means that the at least one cone sliding part 3 is moved along the axis of rotation 4 until the desired focal length is achieved, wherein, when multiple sliding cones 5, 6 are used, they can be moved independently of one another.

In one preferred application, the inventive collimator with adjustable focal length is part of an X-ray inspection system that also has an X-ray source, an X-ray detector and an analysis device for analyzing the detected radiation.

The two aforementioned example embodiments are purely exemplary in nature and are thus not limiting. In particular, the number and size of the cone sliding parts can vary without departing from the concept of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A collimator having an adjustable focal length for an X-ray inspection system, the collimator comprising:

an outer part having a conical inner surface;

an inner part having a conical outer surface, the outer part and the inner part being connected to one another at a fixed distance; and at least one cone sliding part movably arranged between the inner part and the outer part.

2. The collimator according to claim 1, wherein all conical surfaces are arranged concentrically about a common axis of rotation.

3. The collimator according to claim 1, wherein all conical surfaces have the same aperture angle $\alpha$.

4. The collimator according to claim 1, wherein pairs of adjacent conical surfaces have the same aperture angle.

5. The collimator according to claim 1, wherein the at least one cone sliding part travels in a direction of an axis of rotation.

6. A method for adjusting a focal length of a collimator, the method comprising providing a collimator for an X-ray system, the collimator having an outer part having a conical inner surface, an inner part having a conical outer surface, the outer part and the inner part being connected to one another at a fixed distance, and at least one cone sliding part movably arranged between the inner part and the outer part; and moving the at least one cone sliding part along an axis of rotation until a desired focal length is achieved, wherein, when multiple cone sliding parts are used, they are moved independently of one another.

7. An x-ray inspection system comprising:

an X-ray source;

an X-ray detector;

an X-ray detector and an analysis device for analyzing detected radiation; and a collimator with an adjustable focal length, the collimator comprising:

an outer part having a conical inner surface;

an inner part having a conical outer surface, the outer part and the inner part being connected to one another at a fixed distance; and at least one cone sliding part movably arranged between the inner part and the outer part.

* * * * *